United States Patent [19]

Eda et al.

[11] 4,279,498

[45] Jul. 21, 1981

[54] ELECTROSTATOGRAPHIC COPYING APPARATUS WITH AUTOMATIC TONER DENSITY CONTROL

[75] Inventors: Tadahiro Eda; Susumu Tatsumi; Chikara Imai; Yasushi Koichi, all of Tokyo, Japan

[73] Assignee: Ricoh Company, Ltd., Tokyo, Japan

[21] Appl. No.: 103,825

[22] Filed: Dec. 14, 1979

[30] Foreign Application Priority Data

Dec. 28, 1978 [JP] Japan ..... 53-161704
Jun. 27, 1979 [JP] Japan ..... 54-81091

[51] Int. Cl.[3] ..... G03G 15/00

[52] U.S. Cl. ..... 355/14 D; 118/668; 118/679; 118/691; 355/3 DD; 355/14 E

[58] Field of Search ..... 355/14 D, 14 E, 14 CH, 355/14 R, 10, 3 DD, 3 R; 118/668, 679, 688–691, 694

[56] References Cited

U.S. PATENT DOCUMENTS 3,348,522 10/1967 Donohue ..... 355/14 D
3,553,464 1/1971 Abe ..... 118/691 X
4,082,445 4/1978 Steiner ..... 355/14 D

FOREIGN PATENT DOCUMENTS 52-33734 3/1977 Japan ..... 355/14 D

OTHER PUBLICATIONS

*IBM Tech. Disc. Bull.,* "Toner Concentration Control", G. L. Smith, vol. 19, No. 11, Apr. 1977, p. 4078.

*Primary Examiner*—Richard L. Moses
*Attorney, Agent, or Firm*—David G. Alexander

[57] ABSTRACT

A photoconductive drum (32) is charged, radiated with a light image of an original document (34) and developed to produce a toner image. The density of the toner image is sensed and additional toner fed to a developing unit (37) if the sensed density is below a predetermined value. The sensed toner density is compensated for variations in charge potential, light image intensity, electrostatic image potential, developing bias voltage, power supply voltage and/or sensor output so as to be independent of these variables.

19 Claims, 24 Drawing Figures

ELECTROSTATOGRAPHIC COPYING APPARATUS WITH AUTOMATIC TONER DENSITY CONTROL

BACKGROUND OF THE INVENTION

The present invention relates to an electrostatographic copying apparatus comprising means for automatically sensing toner density and adding toner to a developing unit when the sensed toner density drops below a predetermined level.

In such an apparatus, a photoconductive drum or like member is uniformly charged and radiated with a light image of an original document to form an electrostatic image through localized photoconduction. A developing unit applies a developing mixture of toner and carrier particles to the drum to develop the electrostatic image into a toner image.

Whereas the toner is consumed in the developing process, the carrier particles are not. Thus, the toner density, which is defined as the ratio of toner to carrier particles in the developing mixture, progressively decreases. If this process were allowed to continue, the optical density of the copies would progressively decrease to zero.

This effect is overcome as disclosed in Japanese patent publication Nos. 43-16199 and 50-22642 by sensing the density of the toner image after development. The higher the toner density, the higher the sensed density of the toner image. Typically, a non-image portion of the drum which was charged and developed but not imaged will be sensed. As an alternative, a peripheral portion of the drum radiated with a light image of an object having a predetermined optical density is sensed. This compensates for variation in the intensity of a light source which illuminates the document. In accordance with this system, additional toner is added to the developing mixture in the developing unit when the sensed density of the toner image is below a predetermined value.

However, this system as has been proposed thus far in the prior art does not function to accurately sense and adjust the toner density to a predetermined value. This is because the sensed density of the toner image varies in accordance with changes in the charge potential applied to the drum, fatigue of the drum, the intensity of the light image, the developing bias voltage and variations in the power supply voltage and sensor output in addition to the actual toner density.

SUMMARY OF THE INVENTION

An electrostatographic apparatus embodying the present invention includes a photoconductive member, imaging means for forming an electrostatic image on the member and developing means for developing the electrostatic image to form a toner image, and is characterized by comprising, first sensor means for sensing a density of the toner image, second sensor means for sensing a variable operating parameter of at least one of the imaging means and the developing means, control means for controlling the developing means to increase a toner density when said density is below a reference value, and computing means for compensating the control means as a predetermined function of the sensed operating parameter.

In accordance with the present invention, a photoconductive drum is charged, radiated with a light image of an original document and developed to produce a toner image. The density of the toner image is sensed and additional toner fed to a developing unit if the sensed density is below a predetermined value. The sensed toner density is compensated for variations in charge potential, light image intensity, electrostatic image potential, developing bias voltage, power supply voltage and/or sensor output so as to be independent of these variables.

It is an object of the present invention to provide an electrostatographic copying apparatus comprising means for accurately sensing a toner density and adding additional toner when the sensed density drops below a predetermined value.

It is another object of the present invention to provide an electrostatographic copying apparatus comprising means for compensating sensed toner density for variations in operating parameters of the apparatus.

It is another object of the present invention to provide an electrostatographic copying apparatus which produces copies of constant and optimal density.

It is another object of the present invention to provide a generally improved electrostatographic copying apparatus.

Other objects, together with the foregoing, are attained in the embodiments described in the following description and illustrated in the accompanying drawing.

DESCRIPTION OF THE PREFERRED EMBODIMENTS

While the electrostatographic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 2:
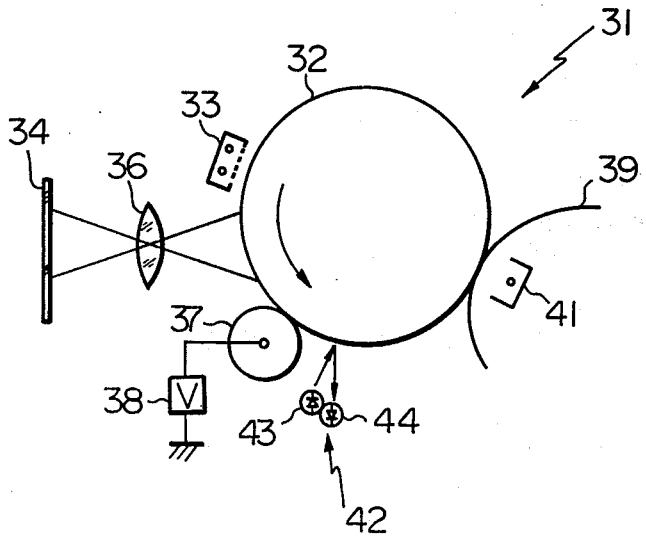
FIG. 2 is a schematic diagram illustrating a basic form of the present invention.

Referring now to FIG. 2 of the drawing, an electrostatographic copying apparatus or machine is generally designated by the reference numeral 31 and comprises a photoconductive member in the form of a drum 32 which is rotated counterclockwise at constant speed. The drum 32 is uniformly charged by a corona charging unit 33 and then radiated with a light image of an original document 34 by an optical unit symbolically illustrated as being embodied by a converging lens 36. The result is that an electrostatic image of the document 34 is formed on the drum 32 by localized photoconduction. Then, a magnetic brush or other type of developing unit 37 applies a developing mixture to the drum 32 to develop the electrostatic image into a toner image. Further illustrated is a bias voltage source 38 which applies a bias voltage to the developing unit 37 to prevent transfer of toner to white background areas of the electrostatic image. Then, a copy sheet 39 is fed into contact with the drum 32 at the same surface speed thereas while a transfer charger 41 applied an electrostatic charge to the copy sheet 39 causing the toner image to be transferred from the drum 32 to the copy sheet 39. The copy sheet 39 is fed at such a timing that the leading edge of the copy sheet 39 registers with the leading edge of the toner image on the drum 32. After transfer, a fixing unit (not shown) fixes the toner image to the copy sheet 39 by heat, pressure or a combination thereof. Also, the drum 32 is discharged and cleaned prior to recharging by the unit 33.

The developing mixture comprises non-magnetic, black toner particles and magnetic carrier particles. Whereas the toner particles are consumed in the developing process, the carrier particles are not. Without replenishment of toner, the toner density, defined as the ratio of the toner particles to the carrier particles in the developing mixture, would progressively decrease to zero. Thus, the density of the images on the copies would also decrease to zero.

For this reason, it is desired to maintain the toner density constant through replenishment of toner, or adding more toner particles to the developing mixture. Optimally, the toner replenishment rate is equal to the toner consumption rate.

However, due to the fact that the toner consumption rate varies in accordance with the type of image, addition of toner at a constant rate will not result in maintaining the toner density at the desired value. Images with large dark areas will cause consumption of toner which is greater than images with few dark areas. Thus, it is necessary to constantly sense the toner density and add toner in accordance therewith. Typically, a predetermined amount of toner will be added when the sensed toner density drops below a predetermined value.

Various methods have been proposed to sense the toner density, such as measuring the magnetic permeability of the developing mixture in the developing unit 37. This method is rather inaccurate since the mixture in the developing unit 37 is not completely homogeneous. Another method to which the present invention constitutes a major improvement is to sense the optical density of the toner image on the drum 32 by means of a sensor 42. The sensor 42 is a photoelectric unit comprising a light source 43 such as a light emitting diode and a photosensor 44 such as a photodiode. The photodiode 44 measures the amount of light reflected from the drum 32 and thereby the optical density of the toner image. In one form of the invention, the sensor 42 is arranged to sense the optical density of a portion of the drum 32 which was charged by the charging unit 33 but not subjected to light radiation by the imaging optical unit 36. In another form of the invention, the sensor 42 is adapted to sense a peripheral portion of the drum 32 on which was radiated a light image of a reference surface having a predetermined optical density. The latter form compensates for variations in the intensity of the light image due to variation in the intensity of a light source (not shown) used to illuminate the document 34.

In either case, the sensed optical density will increase as the toner density increases. Thus, the output of the sensor 42 is a function of the toner density.

Figure 1:
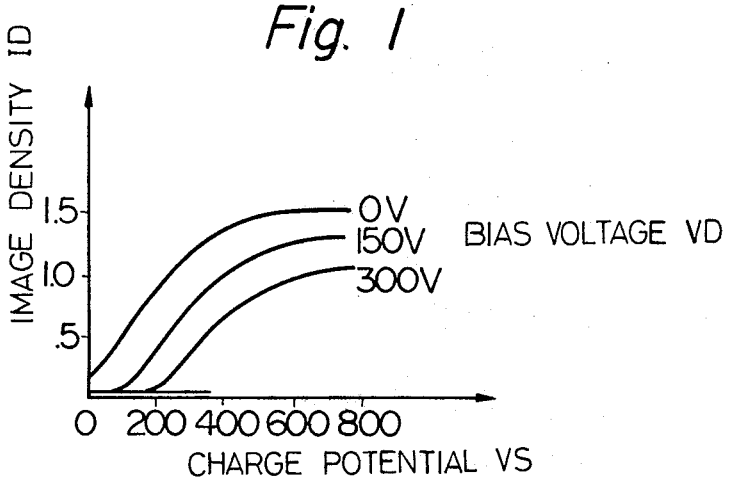
FIG. 1 is a graph illustrating variation of sensed toner image density as functions of developing bias voltage and electrostatic image potential.

However, as shown in FIG. 1, the sensed image density ID depends on other factors such as the potential VS of the electrostatic image on the drum 32 and the bias voltage VD applied by the source 38. The electrostatic image potential VS is a function of the charge applied by the charging unit 33 and the intensity of the light image radiated onto the drum 32 by the optical unit 36 as well as fatigue of the drum 32 and other factors such as ambient temperature and humidity. The density ID also varies in accordance with the voltage supply to the sensor 42. The sensed density ID increases as the charge potential VS increases and decreases as the bias voltage VD increases. In addition, the sensed density ID decreases as the intensity of the light image increases. Thus, it will be seen that simply sensing the optical density of a reference area on the drum 32 will not produce an accurate measure of the toner density.

Figure 3:
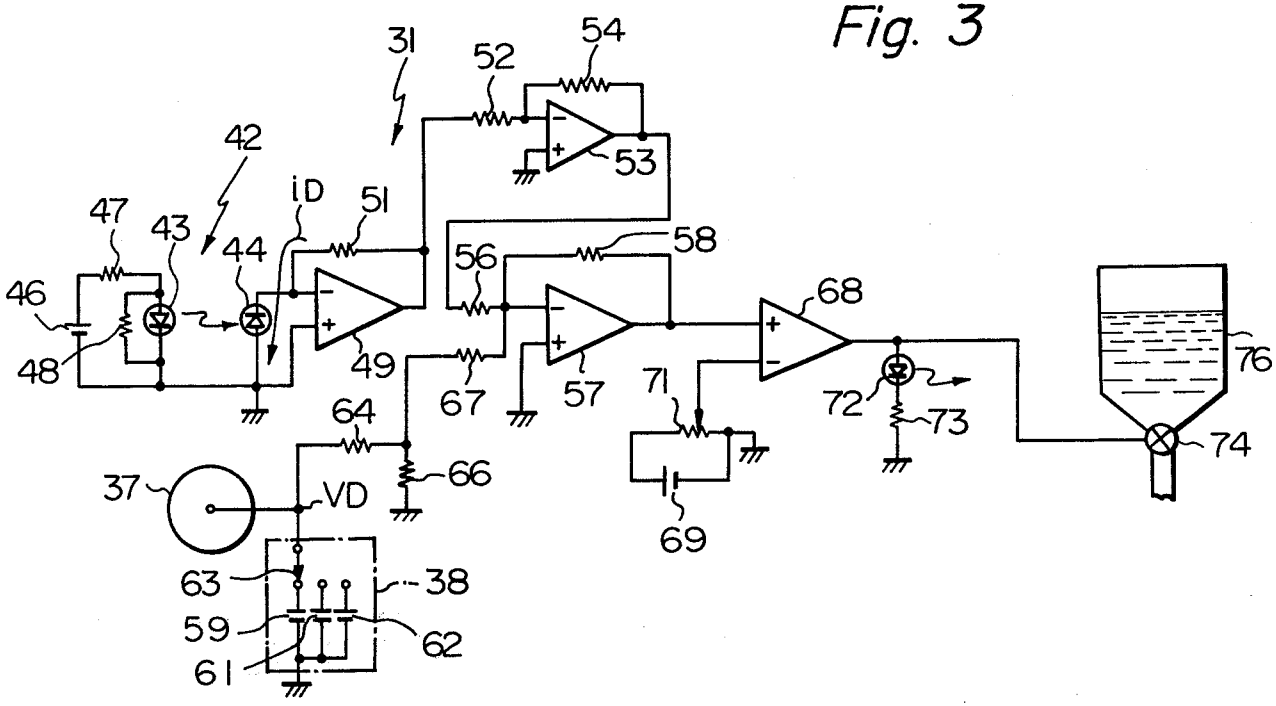
FIG. 3 is an electrical schematic diagram illustrating a first embodiment of the present invention.

This problem is overcome in accordance with the present invention as illustrated in FIG. 3. Current is supplied to the LED 43 from a source 46 through a current limiting resistor 47. Further illustrated is a resistor 48 connected across the LED 43 for temperature compensation.

The cathode of the photodiode 44 and the non-inverting input of an operational amplifier 49 are grounded, with the anode of the photodiode 44 being connected to the inverting input of the operational amplifier 49. A feedback resistor 51 is connected between the output and inverting input of the amplifier 49. As the sensed optical density increases, the resistance of the photodiode 44 increases with the result that the current iD through the photodiode 44 and thereby the output voltage of the amplifier 49 decrease. The output of the amplifier 49 is fed through a resistor 52 to the inverting input of an operational amplifier 53, the non-inverting input of which is grounded. A feedback resistor 54 is connected between the output and inverting input of the amplifier 53. The amplifier 53 acts as an inverter so that the output voltage of the amplifier 53 increases as the sensed optical density increases.

The output of the amplifier 53 is connected through a summing resistor 56 to the inverting input of an operational amplifier 57. A feedback resistor 58 is connected between the output and inverting input of the amplifier 57. The non-inverting input of the amplifier 57 is grounded.

The bias voltage source 38 comprises a plurality of positive voltage sources 59, 61 and 62 which are selectively connected through a switch 63 to the developing unit 37. The sources 59, 61 and 62 produce different voltages and are selected in accordance with the background potential of the original document 34 by means of circuitry which is not the subject matter of the present invention and is not shown. The bias voltage VD depends on which source 59, 61 or 62 is selected. The bias voltage VD is applied to a voltage divider consisting of resistors 64 and 66, with the end of the voltage divider being grounded. The voltage at the junction of the resistors 64 and 66, which is a fraction of the bias voltage VD, is applied through a summing resistor 67 to the inverting input of the amplifier 57.

The amplifier 57 produces an output voltage which is the weighted sum of the output of the amplifier 53 which is proportional to the sensed optical density and the bias voltage VD. Since an increase in the bias voltage VD results in a lower sensed optical density, it is desired to compensate for this effect so that the output of the amplifier 57 is independent of the bias voltage VD and varies only in accordance with the toner density. This is accomplished by the illustrated circuitry. The values of the resistors 56, 64, 66 and 67 are selected so that voltage applied to the amplifier 57 through the resistor 67 compensates for the reduction in sensed optical density caused by an increase in the bias voltage VD and vice-versa. As the bias voltage VD increases, the voltage applied to the amplifier 57 also increases and this is added to the output of the amplifier 53 which corresponds to the sensed optical density. Thus, the amplifier 57 produces at its output a voltage corresponding to the toner density and which is dependent of the bias voltage VD due to the above described compensation.

The compensated optical density signal is applied to the non-inverting input of an operational amplifier 68 which functions as a voltage comparator. A reference voltage from a source 69 is fed through a potentiometer 71 to the inverting input of the amplifier 68. The output of the amplifier 68 is connected to the anode of a light emitting diode 72, the cathode of which is connected to ground through a current limiting resistor 73. The output of the amplifier 68 is also connected to an electromagnetic valve 74 of a toner hopper or reservoir 76.

When the compensated density is above a predetermined reference value corresponding to the voltage applied to the amplifier 68 from the source 69, the output of the amplifier 57 is low, the output of the amplifier 68 is low and the LED 72 is turned off. Also, the low output of the amplifier 68 does not actuate the valve 74. However, when the compensated density is below the predetermined value indicating that the toner density has dropped below a corresponding predetermined value, the output of the amplifier 68 goes high lighting the LED 72. The high output of the amplifier 68 also actuates the valve 74 and causes additional toner to be added to the developing unit 37 from the hopper 76. This increases the toner density. When the toner density has been increased to the predetermined value, the output of the amplifier 68 will go low and de-actuate the valve 74. The LED 72 provides a visual indication to the operator of the apparatus 31 that the toner density is insufficient, and may be replaced by any other suitable annunciator such as a bell, buzzer or siren.

As an alternative, the source 69 may be ommitted and a fraction of the bias voltage applied to the inverting input of the amplifier 68 rather than to the amplifier 57. This would have the effect of raising the reference value as the bias voltage increases to compensate for the reduction in sensed optical density caused by the increase in bias voltage.

Figure 4:
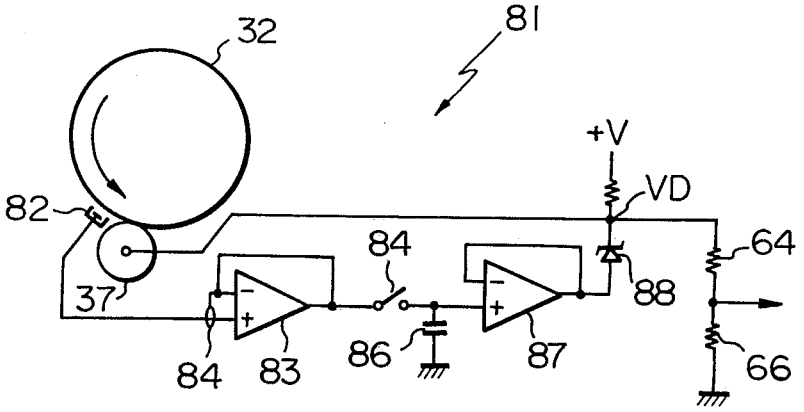
FIG. 4 is an electrical schematic diagram illustrating a second embodiment of the present invention.

Another embodiment of the present invention is illustrated in FIG. 4 and designated as 81. The apparatus 81 utilizes an automatic developing bias system rather than the bias voltage source 38.

The apparatus 81 comprises a capacitively coupled sensor 82 disposed downstream of the optical unit 36. A voltage proportional to the potential in a leading edge portion of the electrostatic image on the drum 32 is induced in an electrode of the sensor 82. The leading edge portion corresponds to a white background portion of the image. The sensor 82 is connected to the non-inverting input of an operational amplifier 83. The output of the amplifier 83 is connected to the inverting input thereof in a voltage follower configuration and also to a shield 84 of the sensor 82. The output of the amplifier 83 is connected to ground through a sampling switch 84 and integrating capacitor 86. The junction of the switch 84 and capacitor 86 is connected to the non-inverting input of an operational amplifier 87.

The output of the amplifier 87 is connected to the inverting input thereof to constitute a voltage follower. The output of the amplifier 87 is also connected to the anode of a zener diode 88, the cathode of which is connected to a positive D.C. source +V. The bias voltage VD appears at the cathode of the diode 88 and is applied to the developing unit 37 and also to the voltage divider consisting of the resistors 64 and 66. The function of the zener diode 88 is to add a predetermined voltage to the output of the amplifier 87.

The output of the amplifier 83 is substantially equal to the electrostatic potential in the leading edge (background) portion of the electrostatic image on the drum 32. The switch 84 is closed when the leading edge portion of the image is adjacent to the sensor 82 for sampling. The zener diode 88 adds a predetermined voltage to the output of the amplifier 83 so that the bias voltage VD is equal to the sensed electrostatic potential plus the zener voltage of the diode 88. This prevents transfer of toner from the developing unit 37 to the white background image areas on the drum 32. The operation of the circuit is the same as described with reference to FIG. 3 except that the bias voltage is applied to the resistors 64 and 66 from the zener diode 88 rather than from the source 38.

Figure 5:
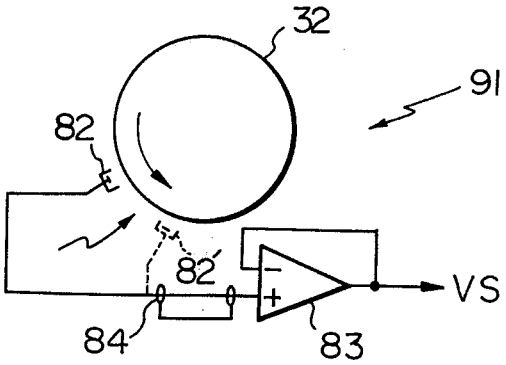
FIG. 5 is an electrical schematic diagram illustrating a third embodiment of the present invention.

FIG. 5 illustrates another embodiment 91 of the present invention in which like elements are designated by the same reference numerals used previously. In this case, the sensed optical density is compensated for variation in the electrostatic charge applied by the charging unit 33 rather than for the developing bias voltage.

The sensor 82 is in this case adapted to sense the electrostatic potential on the drum 32 after charging by the charging unit 33 but before imaging by the optical unit 36. This compensates for fatigue of the drum 32 as well as variation in the magnitude of corona discharge of the unit 33. The output of the amplifier 83 is the charge potential VS. It will be recalled from the description of FIG. 1 that the sensed optical density of the toner image increases as the charge potential VS increases, and that it is necessary to decrease the sensed toner density as the charge potential VS increases.

Figure 6:
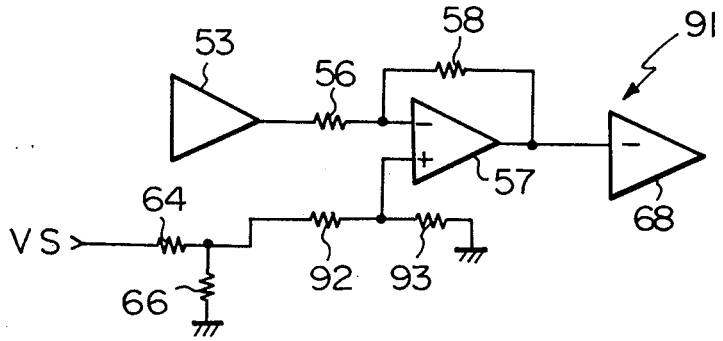
FIG. 6 is an electrical schematic diagram illustrating a fourth embodiment of the present invention.

This is accomplished by the circuitry of FIG. 6. In this case, the charge potential VS is applied to the resistors 64 and 66 rather than the bias voltage VD. The junction of the resistors 64 and 66 is connected to another voltage divider consisting of resistors 92 and 93. The junction of the resistors 92 and 93 is connected to the non-inverting input of the amplifier 57.

In the apparatus 91 the amplifier 57 is adapted to operate as a differential amplifier rather than a summing amplifier. Thus, a weighted fraction of the charge potential VS is subtracted from the sensed optical density to provide the desired compensation.

As an alternative, the sensor 82 may be adapted to sense the charge potential after imaging by the optical unit 36 as indicated in phantom line at 82'. In this case, a sampling arrangment as shown in FIG. 4 should be employed to sense the potential in a dark image area.

Figure 7:
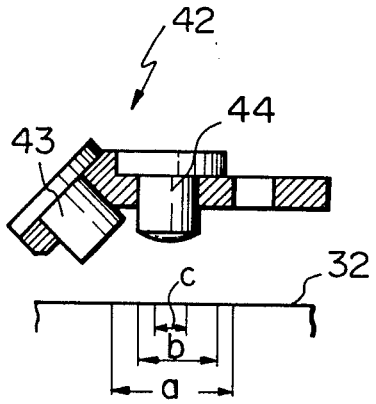
FIG. 7 is an elevational view of a sensor of the present invention.
Figure 8:
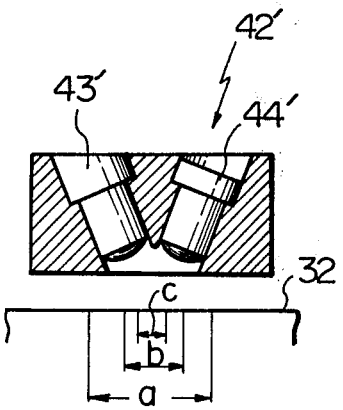
FIG. 8 is similar to FIG. 7 but shows an alternative sensor.

The sensor 42 is shown in FIG. 7 on a scale of about 2:1 in which the light source 43 radiates light onto the drum 32 diagonally whereas the photosensor 44 is aimed perpendicular to the drum 32 surface. FIG. 8 shows another sensor 42' comprising a light source 43' and photosensor 44' which are inclined at equal angles to the drum 32.

The width of the area on the drum 32 which is to be sensed is designated as a. The width illuminated by the light source 43 is designated as b. The width sensed by the photosensor 44 is designated as c. Although the width b is illustrated as being greater than the width c, this relationship may be reversed.

Figure 9:
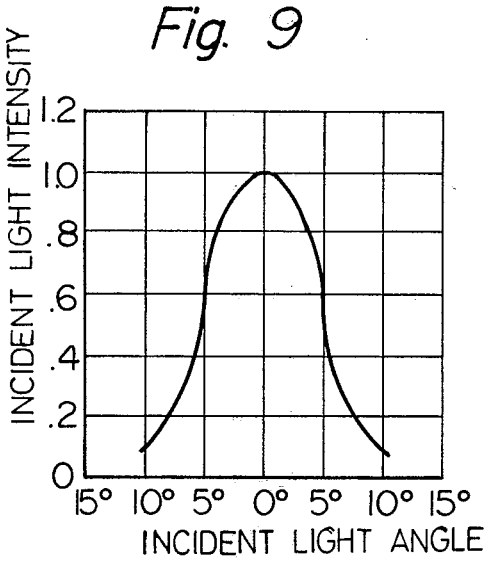
FIG. 9 is a graph illustrating incident light intensity as a function of incident light angle for the sensors of FIGS. 7 and 8.
Figure 10:
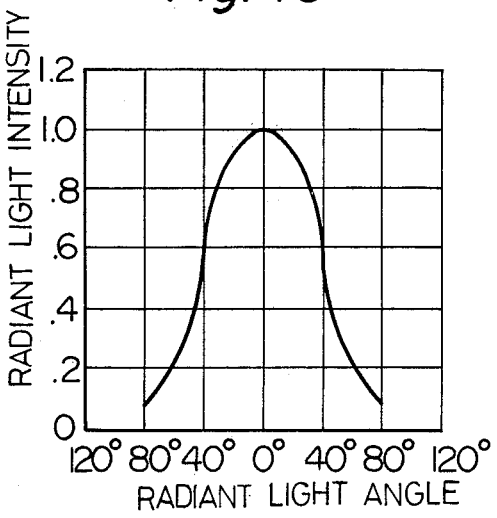
FIG. 10 is a graph illustrating radiant light intensity as a function of radiant light angle for the sensors of FIGS. 7 and 8.

FIG. 9 shows how the angle between the photosensor 44 and drum 32 may be varied within a relatively large range and still produce an accurate output. FIG. 10 similarly shows how the angle between the light source 43 and drum 32 may be varied.

Figure 11:
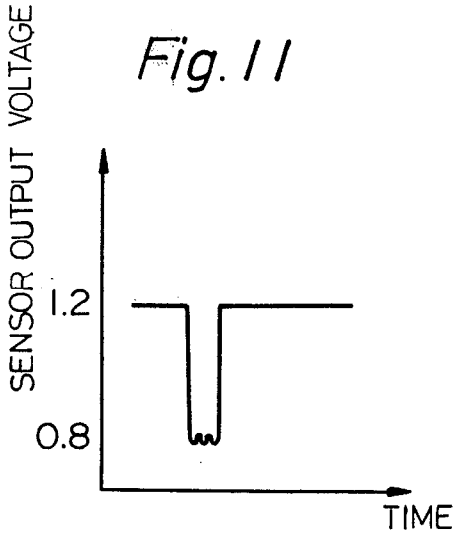
FIG. 11 is a graph illustrating the output of the sensors of FIGS. 7 and 8.

The output voltage of the amplifier 49 which constitutes the sensor output is illustrated in FIG. 11. The output is 1.2 V in areas with no toner but drops down to about 0.8 V when the dark reference area on the drum 32 is sensed after development. However, the output of the amplifier 49 varies to a considerable extent due to the edge effect, localized replenishment of toner in the developing unit 37, flares, scratches on the drum 32 and the like. The sensed toner density (before compensation) corresponds to the lowest output voltage of the sensor 42 which corresponds to maximum optical density.

Figure 12:
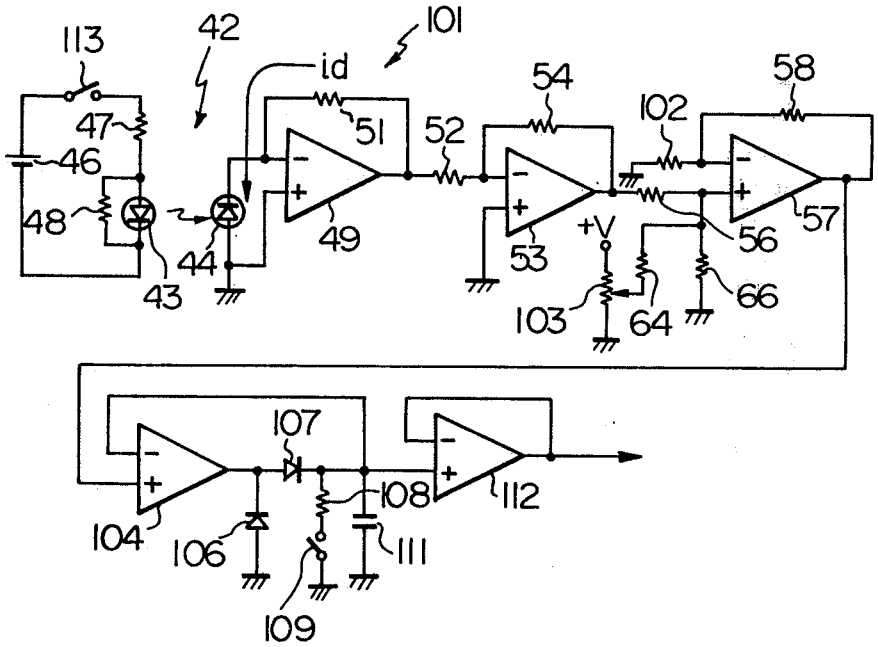
FIG. 12 is an electrical schematic diagram illustrating a fifth embodiment of the present invention.

FIG. 12 illustrates another apparatus 101 which is adapted to provide this function. The resistor 67 is omitted and the junction of the resistors 64 and 66 connected directly to the non-inverting input of the amplifier 57. A resistor 102 is connected between the inverting input of the amplifier 57 and ground. An adjustable voltage is applied to the resistors 64 and 66 through an adjustment potentiometer 103.

The output of the amplifier 57 is connected to the non-inverting input of an operational amplifier 104. The output of the amplifier 104 is connected to the cathode of a diode 106 and to the anode of a diode 107. The anode of the diode 106 is grounded directly and the cathode of the diode 107 is grounded through a resistor 108 and sampling switch 109. The cathode of the diode 107 is also connected to ground through a sampling capacitor 111 and to the non-inverting input of an operational amplifier 112 which is connected to operate as a voltage follower. The output of the amplifier 112 is connected to the inverting input thereof. The cathode of the diode 107 is also connected to the inverting input of the amplifier 104.

Figure 13:
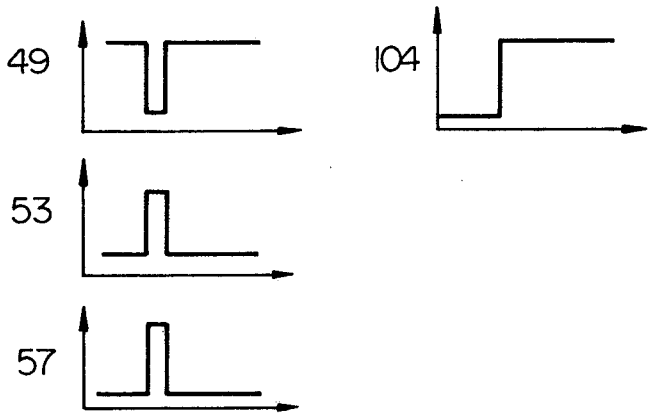
FIG. 13 is a series of graphs illustrating signals at various points in the embodiment of FIG. 12.

The amplifier 104 and associated components function as a peak detector. The outputs of the amplifiers 49, 53, 57 and 104 are illustrated in FIG. 13. The switch 109 is opened when the maximum density reference portion of the drum 32 passes the sensor 42. The output of the amplifier 104 charges the capacitor 111 through the diode 107 to the peak value of the output of the amplifier 104 which corresponds to the toner density. This voltage is applied to the amplifier 112. When the sensing operation is completed, the switch 109 is closed to allow the capacitor 111 to discharge through the resistor 108 and switch 109.

Crystallization of the toner on the drum 32 by heat from the light source 43 would cause erroneous sensing of the optical density. For this reason, a switch 113 is provided to allow current flow to the light source 43 only while sensing the reference area on the drum 32. This arrangement prevents the light source 43 from being turned on long enough to produce any significant amount of heat.

Where a tungsten lamp is used as the light source 43, crystallization may be prevented by means of an optical filter having a wavelength of about 0.9 microns, although not illustrated.

Figure 14:
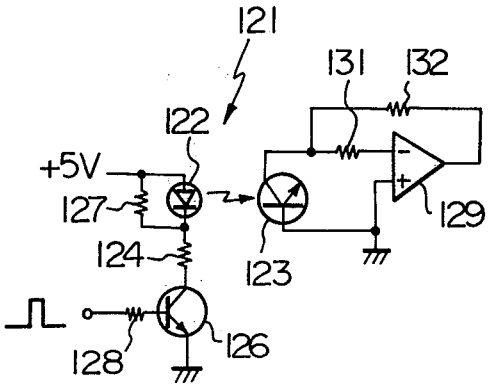
FIGS. 14, 15 and 16 are electrical schematic diagrams illustrating alternative means for preventing toner image crystallization.

FIG. 14 illustrates another photosensor 121 which comprises a light emitting diode 122 and a phototransistor 123. The anode of the diode 122 is connected to a +5 V source. The cathode of the diode 122 is connected through a resistor 124 to the collector of an NPN switching transistor 126. The emitter of the transistor 126 is grounded. A temperature compensation resistor 127 is connected across the diode 127. The light source 122 is turned on by applying a positive signal to the base of the transistor 126 through a resistor 128.

The phototransistor 123 is connected in a diode arrangement with the base thereof grounded. The emitter of the transistor 123 is not connected whereas the collector of the transistor 123 is connected to the inverting input of an operational amplifier 129 through a resistor 131. A feedback resistor 132 is connected between the output of the amplifier 129 and the collector of the transistor 123.

Figure 15:
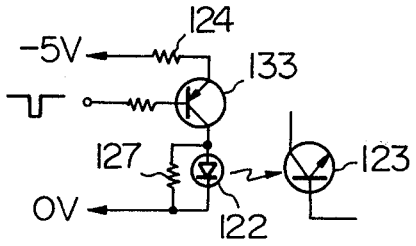

An alternative arrangement is shown in FIG. 15. In this case, the cathode of the light emitting diode 122 is grounded whereas the anode thereof is connected to the collector of a PNP switching transistor 133. The emitter of the transistor 133 is connected through the resistor 124 to +5 V. In this case, a negative signal is applied to the base of the transistor 133 through the resistor 128.

Figure 16:
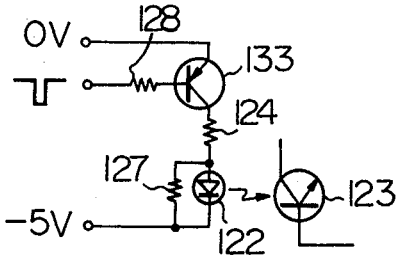

Another alternative version of the circuit of FIG. 14 is shown in FIG. 16 in which the emitter of the transistor 133 is connected to ground whereas the cathode of the diode 122 is connected to −5 V. The resistor 124 is connected between the transistor 133 and diode 122. A negative signal is used to turn on the transistor 133 and light the diode 122.

The circuits of FIGS. 14 and 15 are desirable where the drum 32 is coated with an organic photoconductor. In such a case the electrostatic image has a negative polarity. The circuit of FIG. 16 is useful for a selenium photoconductor for which the electrostatic image potential is positive.

Figure 17:
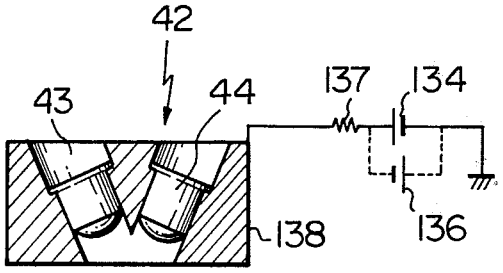
FIG. 17 is a schematic diagram illustrating means for shielding the sensor of FIG. 8.
Figure 18:
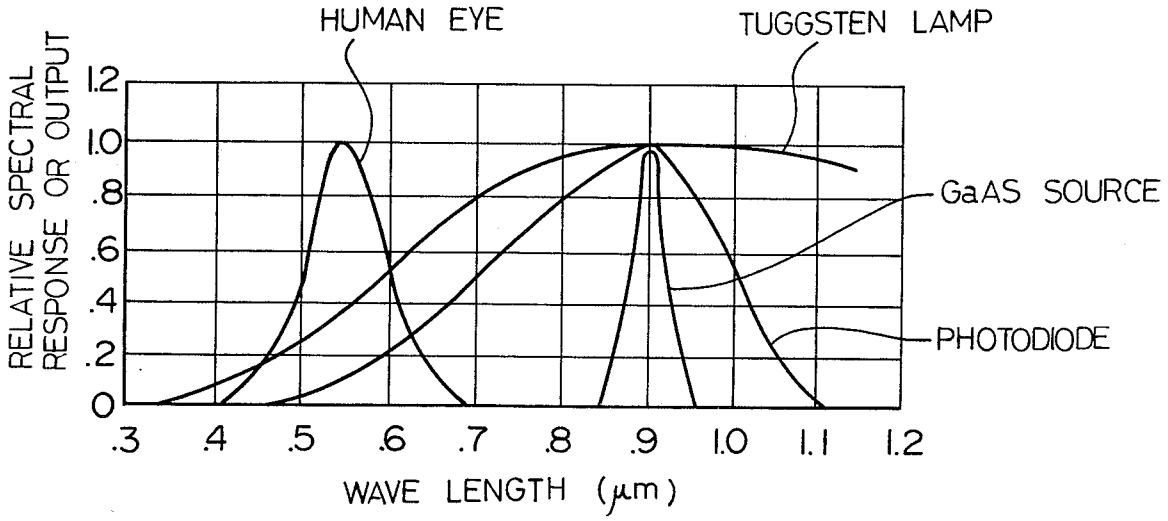
FIG. 18 is a graph illustrating spectrums of various light sources and sensors.

In order to positively prevent contamination of the sensor 42 as shown in FIG. 17, it is possible to mount the light source 43 and photosensor 44 in an electrically conductive housing 138. A voltage source 134 or 136 applies a voltage of the same polarity as the toner to the casing 138 through a resistor 137. This has the effect of repelling the toner away from the sensor 42. FIG. 18 illustrates the spectral output of various types of light sources and receivers.

Figure 19:
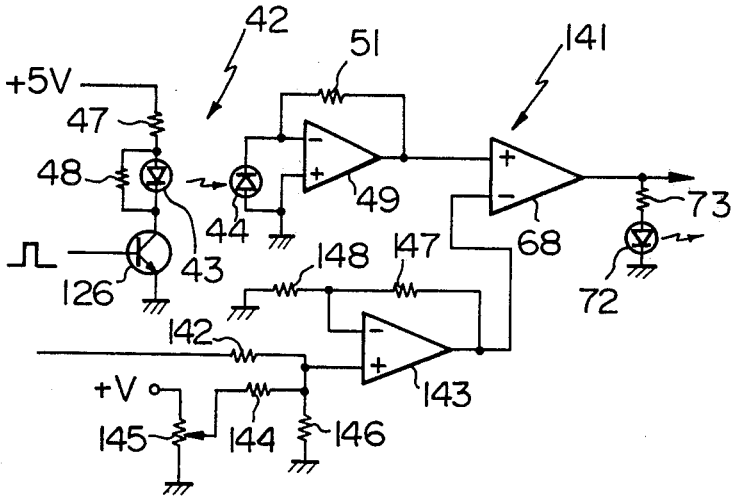
FIG. 19 is an electrical schematic diagram illustrating a sixth embodiment of the present invention.

Another apparatus 141 embodying the present invention is illustrated in FIG. 19. In this case, the reference value is decreased as the bias voltage increases. The output of the amplifier 49 is connected directly to the non-inverting input of the amplifier 68. The bias voltage VD is applied through a resistor 142 to the non-inverting input of an operational amplifier 143. An adjustable voltage is applied via a potentiometer 145 and voltage divider consisting of resistors 144 and 146 to the non-inverting input of the amplifier 143. A feedback resistor 147 is connected between the output and inverting input of the amplifier 143. A resistor 148 is connected between the inverting input of the amplifier 143 and ground. The output of the amplifier 143 is connected to the inverting input of the amplifier 68.

The output of the amplifier 49 decreases as the sensed optical density increases. This output voltage is high when the toner density is insufficient. In such a case the comparator 68 will produce a high output to cause toner replenishment.

The bias voltage VD is added to the voltage from the potentiometer 145 and applied to the amplifier 68 via the amplifier 143. The output of the amplifier 143 increases as the bias voltage VD increases. This corresponds to decreasing the reference voltage as the bias voltage increases. Thus, the amplifier 68 will produce a high output at a progressively lower value of sensed optical density as the bias voltage VD is increased. This compensates for the reduction in sensed density caused by the increase in bias voltage.

Generally, sensors such as 42 are manufactured in modular form and mounted at the desired position in the copying machine. In addition to mounting errors, variations in the output of a conventional 5 V or 12 V power supply (on the order of 10%) cause significant variation in the intensity of the light source 43. This in turn affects the sensed optical density. Various means may be employed to maintain the intensity of the light source 43 constant, including the following.

1. Power the light source with a constant current power supply.
2. Power the light source with a constant voltage power supply.
3. Compensate the reference value in the sensor circuit for variations in power supply voltage.

Figure 20:
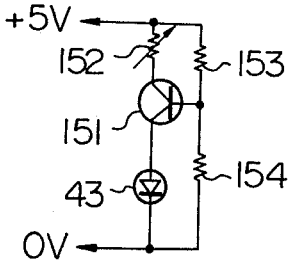
FIG. 20 is an electrical schematic diagram illustrating a constant current source for stabilizing an intensity of a light source against variations in supply voltage.

A well known constant current power supply is illustrated in FIG. 20 and comprises a PNP transistor 151 having a collector connected to the anode of the light emitting diode 43, the cathode of the diode 43 being grounded. The emitter of the transistor 151 is connected through a variable resistor 152 to a +5 V source. Resistors 153 and 154 are connected between the +5 V source and ground, with the junction of the resistors 153 and 154 being connected to the base of the transistor 151.

An increase in the current through the diode 43 reduces the forward bias of the transistor 151 and decreases the current to the desired value.

Figure 21:
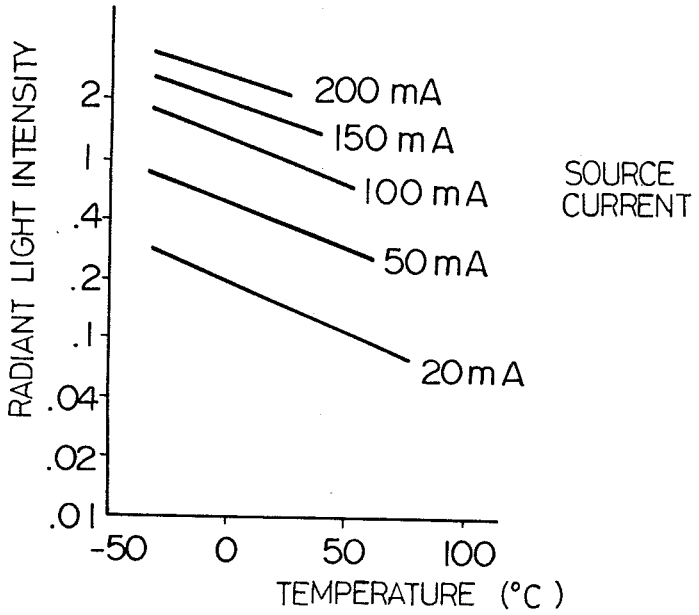
FIG. 21 is a graph illustrating radiant light intensity of a light source as functions of applied current and temperature.
Figure 22:
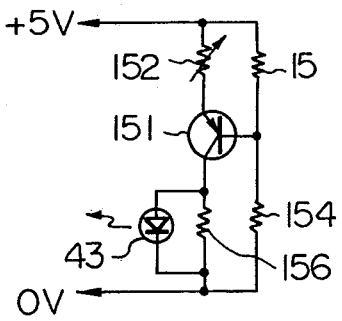
FIG. 22 is an electrical schematic diagram illustrating how the circuit of FIG. 20 may be compensated for temperature variation.

A problem with the circuit of FIG. 20 is that the intensity of the light source 43 varies as a function of temperature as shown in FIG. 21. This problem may be obviated as shown in FIG. 22 by connecting a temperature compensating resistor 156 across the diode 43.

Figure 23:
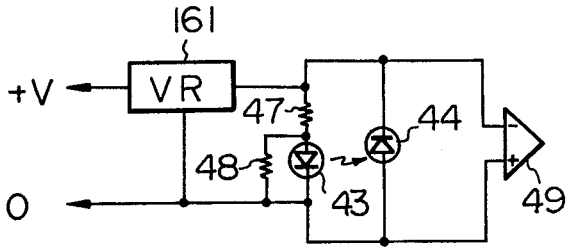
FIG. 23 is a schematic view illustrating a voltage regulator for stabilizing an intensity of a light source against variations in supply voltage.

FIG. 23 illustrates a voltage regulator 161 for providing a constant voltage to the light source 43. Although the regulator 161 is disadvantageous from the viewpoint of production cost, it does solve the problem and furthermore eliminates interference between the units in the apparatus when regulating the voltage only to the light source 43. Compensation of the reference level may be provided using the apparatus 141 of FIG. 19 where the power supply voltage is applied to the potentiometer 145.

Figure 24:
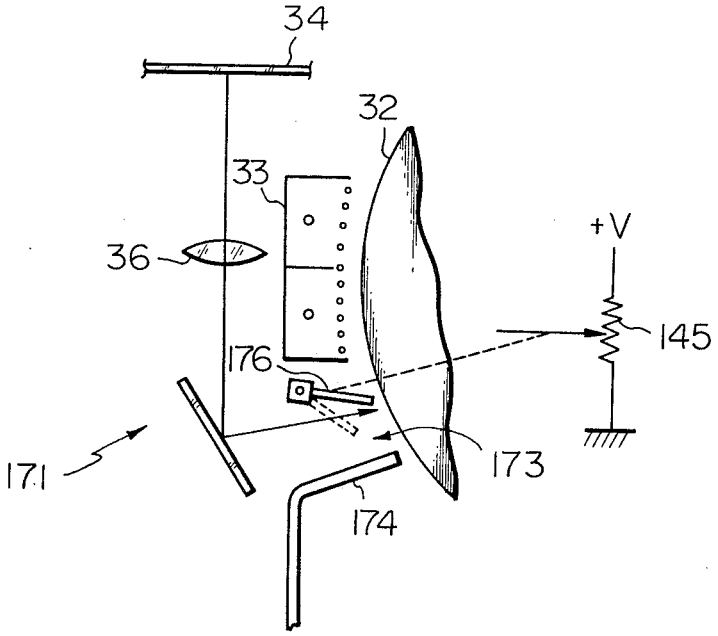
FIG. 24 is a schematic view of the basic components of a seventh embodiment of the present invention.

As discussed hereinabove, the sensed optical density also decreases as the intensity of the light image increases. This may be compensated for in an apparatus 171 shown in FIG. 24. The light image is reflected by a mirror 172 through a slit 173 defined by a fixed plate 174 and a movable plate 176. Typically, a knob (not shown) will be provided on the front of the apparatus 171 for manual adjustment of the width of the slit 173 and thereby the intensity of the light image. The wider the slit 173, the higher the intensity of the light image and the lower the sensed optical density.

As illustrated, the movable plate 176 is mechanically linked to the slider of the potentiometer 145 shown in FIG. 19 in such a manner that the voltage applied by the potentiometer 145 to the amplifier 143 increases as the width of the slit 173 increases. This has the same effect as increasing the developing bias voltage in that the reference level decreases as the light image intensity increases. Alternative means such as a photosensor may be provided to sense the intensity of the light image, although not shown.

In summary, it will be seen that the present invention overcomes the drawbacks of the prior art and provides an electrostatographic copying apparatus in which the toner density is accurately sensed and adjusted to a predetermined optimum level. Various modifications will become possible for those skilled in the art after receiving the teachings of the present disclosure without departing from the scope thereof.

What is claimed is:

1. An electrostatographic apparatus including a photoconductive member, imaging means for forming an electrostatic image on the member and developing means for developing the electrostatic image to form a toner image, characterized by comprising:

first sensor means for sensing a density of the toner image;

second sensor means for sensing a variable operating parameter of at least one of the imaging means and the developing means;

control means for controlling the developing means to increase a toner density when said density is below a reference value; and computing means for compensating the control means as a predetermined function of the sensed operating parameter.

2. An apparatus as in claim 1, in which the computing means is responsive to the first and second sensor means and constructed to compute a compensated density as a predetermined function of said density and sensed operating parameter, the control means controlling the developing means to increase the toner density when the compensated density is below the reference value.

3. An apparatus as in claim 1, in which the computing means is constructed to compute the reference value as a predetermined function of the sensed operating parameter, the control means controlling the developing means to increase the toner density when said density is below the reference value.

4. An apparatus as in claim 2, in which the second sensor means is constructed to sense a developing bias voltage of the developing means.

5. An apparatus as in claim 4, in which the computing means is constructed to increase the compensated density the developing bias voltage increases.

6. An apparatus as in claim 2, in which the imaging means comprises charging means for uniformly charging the member and optical means for radiating a light image of an original document onto the member.

7. An apparatus as in claim 6, in which the second sensor means is constructed to sense an electrostatic potential of the member after charging by the charging means and before radiation of the light image by the optical means.

8. An apparatus as in claim 7, in which the computing means is constructed to decrease the compensated density as the electrostatic potential increases.

9. An apparatus as in claim 6, in which the second sensor means is constructed to sense an intensity of the light image radiated by the optical means.

10. An apparatus as in claim 9, in which the computing means is constructed to increase the compensated density as the light image intensity increases.

11. An apparatus as in claim 1, in which the first sensor means comprises photosensor means having a light source and a photosensor.

12. An apparatus as in claim 11, further comprising means for stabilizing an intensity of the light source.

13. An apparatus as in claim 3, in which the second sensor means is constructed to sense a developing bias voltage of the developing means.

14. An apparatus as in claim 13, in which the computing means is constructed to decrease the reference value as the developing bias voltage increases.

15. An apparatus as in claim 3, in which the imaging means comprises charging means for uniformly charging the member and optical means for radiating a light image of an original document onto the member.

16. An apparatus as in claim 15, in which the second sensor means is constructed to sense an electrostatic potential of the member after charging by the charging means and before radiation of the light image by the optical means.

17. An apparatus as in claim 16, in which the computing means is constructed to increase the reference value as the electrostatic potential increases.

18. An apparatus as in claim 15, in which the second sensor means is constructed to sense an intensity of the light image radiated by the optical means.

19. An apparatus as in claim 18, in which the computing means is constructed to decrease the reference value as the light image intensity increases.

* * * * *